US006046686A

United States Patent [19]

Mitchell et al.

[11] Patent Number: 6,046,686

[45] Date of Patent: Apr. 4, 2000

[54] VIOLATION ALERT SPEED DISPLAY

[75] Inventors: Thomas E. Mitchell; William Lee Roberts, both of Chanute, Kans.

[73] Assignee: Kustom Signals, Inc., Lenexa, Kans.

[21] Appl. No.: 08/933,152

[22] Filed: Sep. 18, 1997

[51] Int. Cl.[7] ..... G08G 1/01

[52] U.S. Cl. ..... 340/936; 340/905; 340/933

[58] Field of Search ..... 340/936, 933, 340/938, 905, 908, 908.1, 910, 917, 937, 466

[56] References Cited

U.S. PATENT DOCUMENTS

| | | | |
|---|---|---|---|
| 3,054,087 | 9/1962 | Clegg | 340/936 |
| 3,544,958 | 12/1970 | Carey et al. | 340/936 |
| 3,626,413 | 12/1971 | Zachmann | 340/905 |
| 3,691,525 | 9/1972 | McClellan, Sr. et al. | 340/936 |
| 3,983,531 | 9/1976 | Corrigan | 340/936 |
| 4,031,510 | 6/1977 | King | 340/936 |
| 4,173,010 | 10/1979 | Hoffmann | 340/936 |
| 4,894,641 | 1/1990 | Yang | 340/466 |
| 4,988,994 | 1/1991 | Loeven | 340/936 |
| 5,173,681 | 12/1992 | Schockley et al. | 340/441 |
| 5,231,393 | 7/1993 | Strickland | 340/936 |
| 5,381,155 | 1/1995 | Gerber | 340/936 |
| 5,525,996 | 6/1996 | Aker et al. | 342/104 |
| 5,659,290 | 8/1997 | Haeri | 340/441 |

*Primary Examiner*—Thomas Mullen
*Assistant Examiner*—Toan N. Pham
*Attorney, Agent, or Firm*—Chase & Yakimo, L.C.

[57] ABSTRACT

A speed display device for focusing a motorist's attention on the vehicle's speed, includes a screen which will digitally display thereon the vehicle's radar measured speed in either a first steady state at one color or in a flashing state at a second color. An internal microprocessor compares a preset threshold speed with the vehicle's measured speed. If the measured vehicle's speed is not greater than the threshold speed, the measured speed is screen displayed by energization of a first set of amber lights in a pattern according to the measured speed. If the measured speed is above the threshold speed, a second set of red flashing lights is energized in an accentuated pattern according to the measured speed. The device focuses the motorist's attention on the vehicle speed per se, particularly when above the threshold limit.

20 Claims, 3 Drawing Sheets

VIOLATION ALERT SPEED DISPLAY

BACKGROUND OF THE INVENTION

This invention pertains to a device which displays the speed of an oncoming vehicle and, more particularly, to a highly visible, dual-color display indicative of an oncoming vehicle's speed and whether the vehicle is exceeding a threshold speed, e.g., the posted speed limit for that area.

Vehicle speed display devices are known. In such devices, a radar is mounted in a housing positioned along a roadway. As a vehicle approaches, the vehicle's speed is measured and displayed. One such device is as shown in U.S. Pat. No. 5,231,393 to Strickland. Some systems utilize flashing lights or other messages, apart from the actual vehicle speed display, to attract the driver's attention. One such device is shown in U.S. Pat. No. 3,544,958 to Carey et al.

One problem with past devices is that the driver's attention is not focused on the actual speed display. The flashing lights and other messages can divert the driver's attention away from the actual speed display which defeats the purpose of the device, particularly if the driver does not take any corrective action. None of these devices incorporates a speed display that changes color and flashes upon the vehicle's speed exceeding a threshold speed, e.g., a road's speed limit.

It is desirable to provide a highly visible dual-color display that displays the vehicle speed in a constant, relatively subdued color when below a selected threshold speed limit, but displays the speed in a flashing, accentuating color upon the vehicle exceeding the threshold speed. In this manner, the attention of a vehicle driver will be focused on the speed, particularly when exceeding the speed limit. Vehicle drivers, exceeding the threshold speed, e.g., the posted speed limit, are thus given a highly visible warning so that corrective action can be taken.

SUMMARY OF THE INVENTION

It is therefore the primary object of the present invention to provide a highly visible, dual-color vehicle speed display of a vehicle's measured speed.

A further object of the present invention is to provide a device, as aforesaid, which displays a vehicle speed in either first or second colors according to the vehicle's speed relative to a preselected threshold speed.

Another important object of this invention is to provide a device, as aforesaid, which flashes the vehicle speed when the measured speed exceeds a preselected threshold speed and changes color to direct the vehicle driver's attention to the excessive speed.

These and other objects of the invention are achieved by an apparatus which measures the speed of an approaching vehicle and then compares the measured speed to a user preset threshold speed limit, e.g., the posted speed limit for the road of vehicle travel. If the measured speed is less than or equal to the preset threshold speed, the vehicle's speed is shown in a first color at a steady state on a highly visible screen display. If the measured speed is greater than the preset threshold speed, the vehicle's speed is shown in a second, flashing or otherwise accentuated color on the screen display. The use of the first relatively subdued display and the second accentuated, attention grabbing display more readily focuses the driver's attention on the fact that the threshold speed is being exceeded.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figure 1:
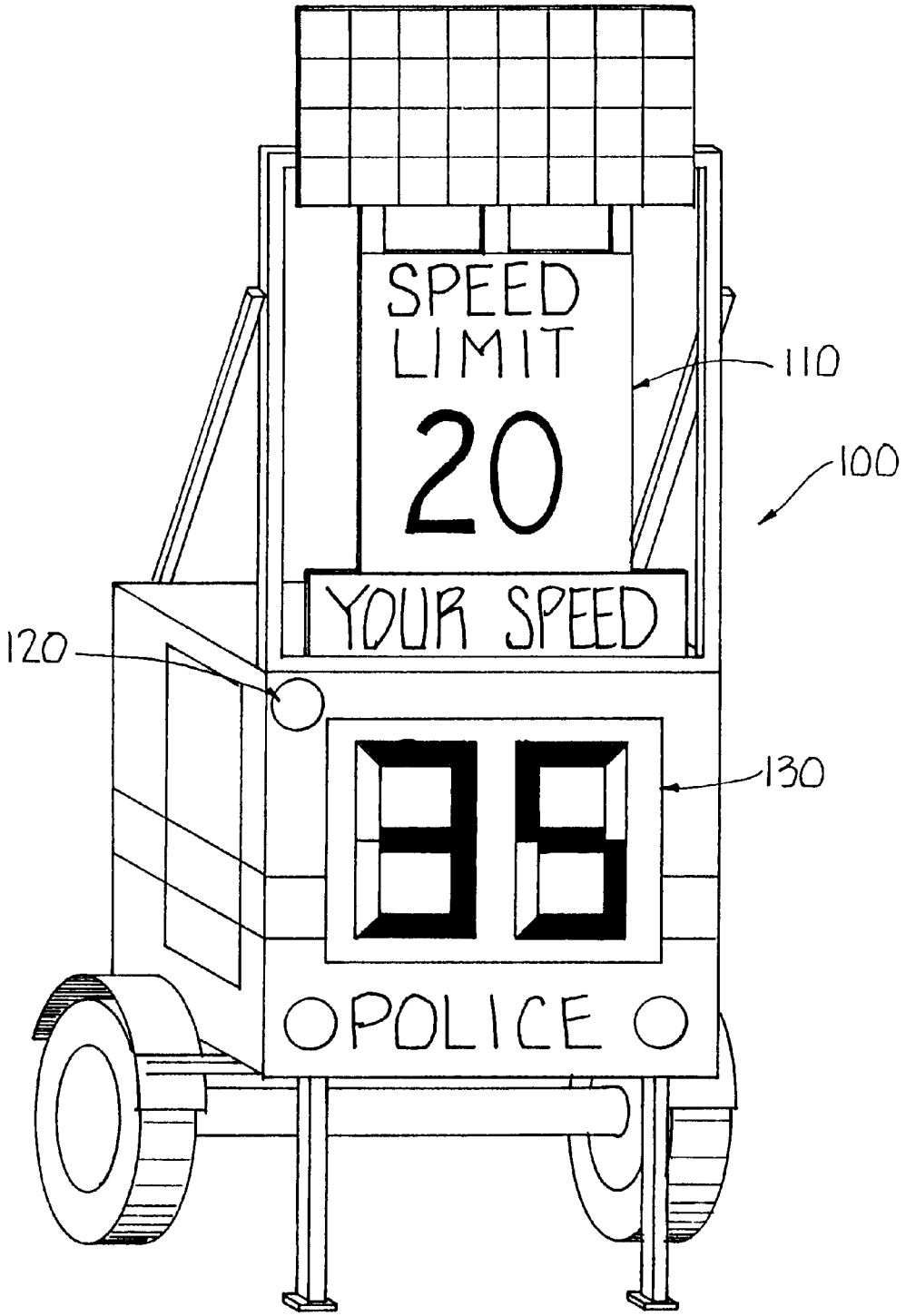
FIG. 1 is a perspective view of a radar trailer showing the dual-color display.
Figure 2:
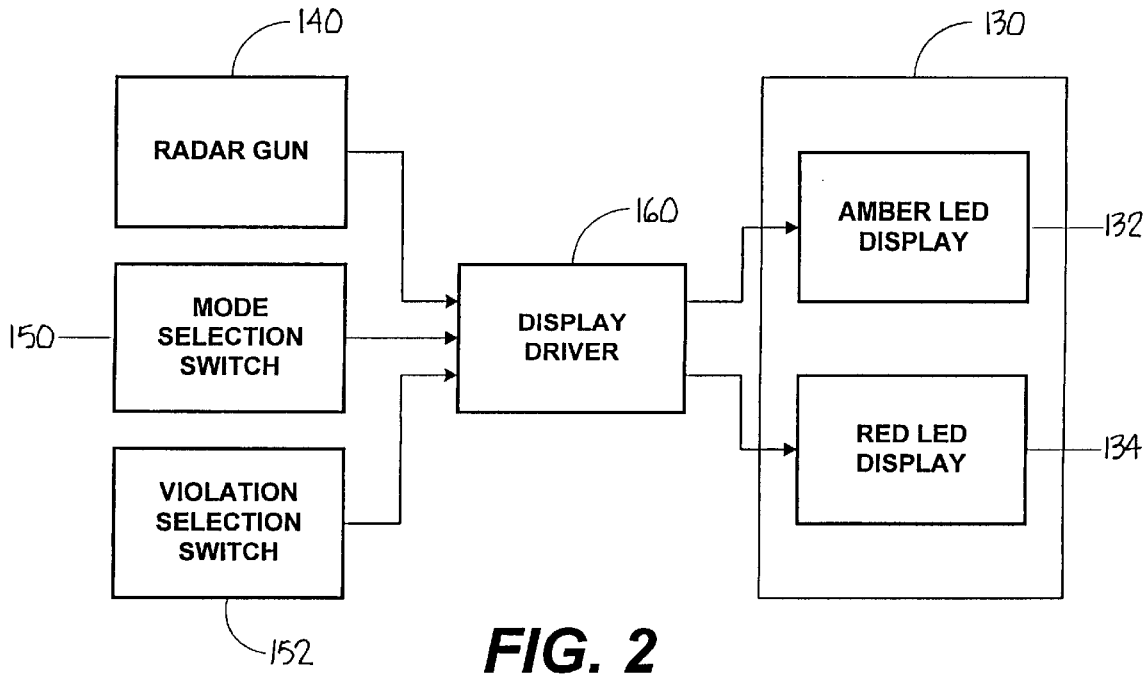
FIG. 2 is a functional block diagram of the display system illustrating the interfaces of the major components.

Turning more particularly to the drawings, FIGS. 1 and 2 illustrate a radar trailer 100 with a releasable speed limit sign 110. Speed limit sign 110 shows the legal speed limit for a particular location. Radar transparency 120 corresponds to the placement of a radar gun 140 housed within radar trailer 100. Screen display 130 which is mounted in trailer 100 exhibits the speed of a vehicle measured by radar gun 140 or by other speed measuring devices, e.g., a laser based speed measurement system.

Figure 3:
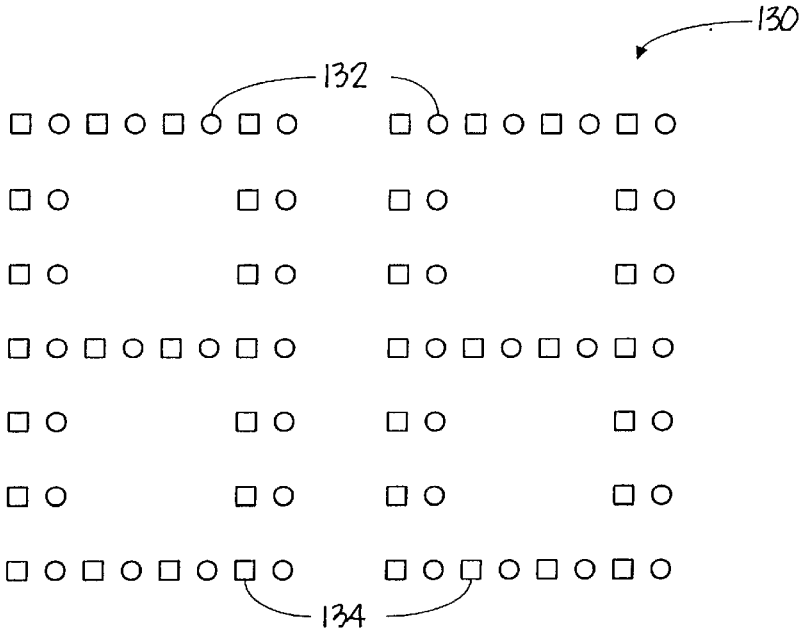
FIG. 3 is a diagrammatic view showing the first set of lights as circular indicia and a second integrated set of lights as square indicia.

The violation alert speed device includes a radar gun 140, a mode selection switch 150, and a violation speed selection switch 152 connected to a display driver 160 which is capable of inserting a preselected threshold speed into the to-be described program logic, e.g., the posted speed limit for the road of vehicle travel. (We refer to such speed herein as the violation speed although it is understood that the threshold speed may be indicative of another speed parameter.) Mode selection switch 150 is a two-position toggle switch. Violation speed switch 152 is a three-position, center-return momentary switch. The vehicle speed output of display driver 160 is then transferred to display 130 in either of two modes. Display 130, shown in FIG. 3, is preferably composed of two sets of light emitting diodes (LEDs) capable of exhibiting at least two colors in at least a constant and a flashing mode. The color of the first set of LEDs 132 associated with the constant mode is preferably amber and the color of the second set of LEDs 134 associated with the flashing mode is a more accentuated color, preferably red. The display 130 is at least approximately 18 inches high. An internal power source, e.g., a battery, provides the necessary power.

Figure 4:
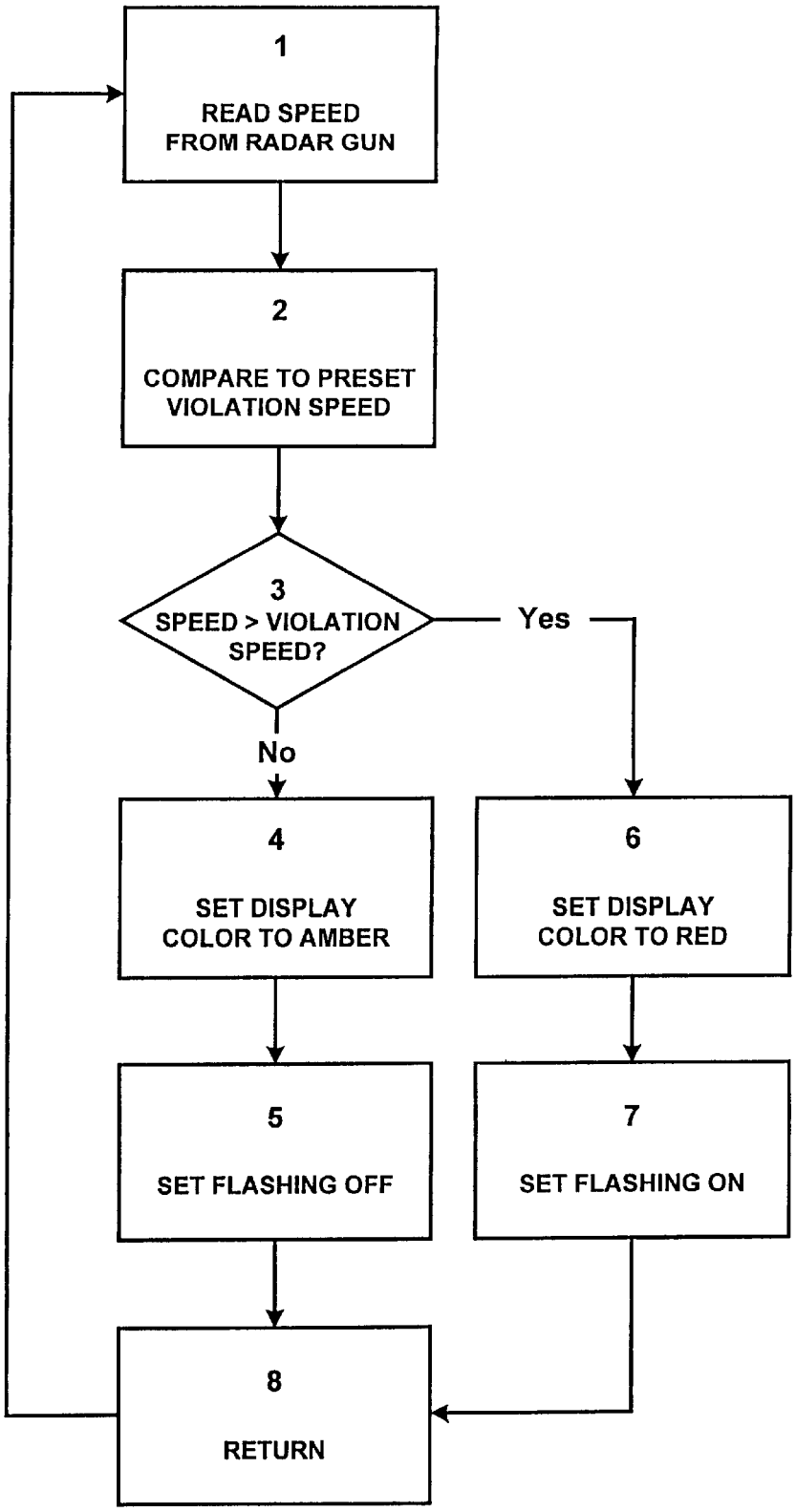
FIG. 4 is a flow chart of the software that controls the display settings.

FIG. 4 illustrates a flow chart of the display driven program that compares the speed data and then processes the speed display data for delivery to the dual-color display 130. Each processing and decision block is identified in the flow chart by a numerical designation from 1 to 8.

When trailer 100 is set up alongside a roadway, a speed limit sign 110 is placed on trailer 100 showing the speed limit for the particular roadway. The mode selection switch 150 is moved to the "set" position. The violation speed selection switch 152 is toggled up or down to increment or decrement the violation speed respectively. Once the desired violation speed is set, the mode selection switch 150 is moved to the "run" position.

When an approaching vehicle is detected, the vehicle's speed from the radar gun 140 is read (block 1) and compared to a speed corresponding to preset violation speed switch 152 (block 2). If the radar speed is less than or equal to the preset violation speed (block 3) the amber LED display 132 is turned on (block 4) and display flashing is set to off (block 5). The display driver includes means for converting the read speed from radar gun at 1 into a signal which will energize a selected number of lights in either display 132, 134 so that the appropriate 0–9 digit will be displayed. Various manners of converting signals to numerical information may be used so as to digitally display the measured speed between 00–99 m.p.h. Processing then continues (block 8) and starts over with the next speed measured by the radar gun 140. If the radar speed is greater than the preset violation speed (block 3) then the red LED display 134 is turned on (block 6) and display flashing is set to on (block 7). The measured violation speed is so displayed at 130 in an accentuated state relative to the subdued state when the violation speed has not been exceeded. Again, processing continues (block 8) for the next measured speed from radar gun 140.

It is understood that the above program may be in the form of a microprocessor which receives the measured speed signal from the radar gun or other speed measurement device and compares the vehicle speed to the preselected violation speed. Upon a comparison being made of the vehicle speed to the preselected violation speed, the display driver 160 will cause the speed to be displayed in either a first mode, i.e., a constant display of a first amber color or a second mode which accentuates the speed display, e.g., a flashing red color. Those skilled in the art can arrive at apparatus to arrive at the above display so as to display the measured vehicle speed in the amber and/or flashing red modes as above described.

Alternatively, it is understood that a single color display may be used which displays a vehicle's speed below the violation speed in a constant mode, and which displays a vehicle's speed exceeding the violation speed in a flashing mode. It is also understood that other forms of first and second speed displays may be used so that the second mode is a more attention focusing display than the display in a relatively subdued first mode.

It is to be understood that while a certain now preferred form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A speed measuring and display device comprising:

speed measuring means for providing a signal indicative of an object's actual speed;

means for providing a signal indicative of a threshold speed preset by a user;

display means for exhibiting said signal indicative of said object's speed in a readable form, said display means having a first mode for exhibiting the object's speed in a first color in at least two numeric digits, and a second mode for exhibiting said object's speed in a second color in at least two numeric digits;

means for driving said display means and including logic means for comparing the object's speed to said threshold speed, said comparing means providing a first speed mode to said measured speed upon the object's speed not being above said threshold speed and a second speed mode upon the object's speed being above said threshold speed, said driving means placing said display means in said first mode thereof upon receipt of said first speed mode from said comparing means or placing said display means in said second mode thereof upon receipt of said second speed mode from said comparing means.

2. The speed measuring and display device as claimed in claim 1 wherein said display means first mode exhibits the object's speed in a steady state.

3. The speed measuring and display device as claimed in claim 2 wherein said display means second mode exhibits the object's speed in a flashing state.

4. The speed measuring and display device as claimed in claim 1 wherein said speed measuring means comprises a radar gun.

5. The speed measuring and display device as claimed in claim 1 wherein said first color of said display means is amber and said second color of said display means is red.

6. The speed measuring and display device as claimed in claim 1 wherein the object is a vehicle.

7. A vehicle speed measuring and display device comprising:

means for providing a signal indicative of a vehicle's actual speed;

means for comparing said signal indicative of the vehicle's measured speed with a signal indicative of a threshold speed desired by a user, said comparing means generating information indicative of whether said measured speed signal is greater than said desired threshold speed signal;

means for providing to said comparing means said signal indicative of the threshold speed;

a screen display for exhibiting said vehicle's measured speed in a digital form, said display means having a first set of visual indicia of a first color and a second set of visual indicia of a second color adapted to display in a selectable pattern at least the digits 00 through 99 upon a selectable energization thereof;

means for energizing either said first set of visual indicia or said second set of visual indicia in said selectable pattern corresponding to the vehicle's measured speed, said second set of visual indicia energized upon said information being generated by said comparing means whereby said screen digitally displays said second set of visual indicia upon said measured speed being greater than said threshold speed.

8. The speed measuring and display device as claimed in claim 7 wherein said second set of visual indicia flash upon said energization thereof.

9. The speed measuring and display device as claimed in claim 7 wherein said first color of said first set of visual indicia is amber and said second color of said second set of visual indicia is red.

10. The speed measuring and display device as claimed in claim 3 wherein said first color of said first set of visual indicia is amber and said second color of said second set of visual indicia is red.

11. The speed measuring and display device as claimed in claim 8 wherein said first and second colors are similar, said flashing of said second set of visual indicia accentuating said speed display relative to said speed display in said energized first set of visual indicia.

12. A method for warning a vehicle driver of exceeding a speed limit comprising the steps of:

a. measuring the vehicle's speed;

b. comparing the measured vehicle's speed to a preselected speed limit;

c. determining whether the measured vehicle speed is not above the speed limit;

d. providing a screen at a roadside location for visually displaying the measured vehicle speed;

e. exhibiting the measured vehicle speed on said screen in a first color if said measured vehicle speed is not above the speed limit;

f. exhibiting the measured vehicle speed on said screen in a second color if said measured vehicle speed is above the speed limit.

13. The method as claimed in claim 12 wherein said first display is in a steady state and said second display is in a flashing state.

14. The method as claimed in claim 12 wherein said second color is accentuated relative to said first color.

15. The method as claimed in claim 12 further comprising the step of repeating steps a–f for a subsequent vehicle.

16. The method as claimed in claim 12 further comprising the step of repeating steps a–f for the vehicle.

17. The method as claimed in claim 12 further comprising the step of utilizing a posted speed limit of the vehicle's road of travel as the preselected speed limit.

18. A vehicle speed measuring and display device comprising:

means for providing a signal indicative of an approaching vehicle's actual speed, means for comparing said signal with a selected threshold speed, means for displaying said vehicle's speed in a digital form at a roadside location, said display means having electrically responsive indicia for displaying at least two numeric digits, and means responsive to said comparing means for energizing said indicia in a steady state to display a first color in the digits corresponding to the vehicle's speed when the vehicle's speed is below said threshold speed, and energizing said indicia in a flashing state to display a second color in the digits corresponding to the vehicle's speed when the vehicle's speed is above said threshold speed.

19. The speed measuring and display device as claimed in claim 18 wherein said first color is amber and said second color is red.

20. A vehicle speed measuring and display device comprising:

means for providing a signal indicative of an approaching vehicle's actual speed, means for comparing said signal with a selected threshold speed, means for displaying said vehicle's speed in a digital form at a roadside location, said display means having electrically responsive indicia for displaying at least two numeric digits in a first or a second color, and means responsive to said comparing means for energizing said indicia to display the digits of the first color corresponding to the vehicle's speed when the vehicle's speed is below said threshold speed, and energizing said indicia to display the digits of said second color corresponding to the vehicle's speed when the vehicle's speed is above said threshold speed.

* * * * *

UNITED STATES PATENT AND TRADEMARK OFFICE

CERTIFICATE OF CORRECTION

PATENT NO. : 6,046,686
APPLICATION NO. : 08/933152
DATED : April 4, 2000
INVENTOR(S) : Thomas E. Mitchell and William Lee Roberts It is certified that error appears in the above-identified patent and that said Letters Patent is hereby corrected as shown below:

Column 3, in claim 10, line 52, delete "claim 3" and substitute --claim 8-- therein.

Signed and Sealed this

Seventeenth Day of July, 2007

JON W. DUDAS
*Director of the United States Patent and Trademark Office*